US008281753B2

(12) United States Patent
Shintani et al.

(10) Patent No.: US 8,281,753 B2
(45) Date of Patent: Oct. 9, 2012

(54) COOLING APPARATUS

(75) Inventors: Osamu Shintani, Toyota (JP); Eizou Takahashi, Chiryu (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 634 days.

(21) Appl. No.: 12/448,277

(22) PCT Filed: Jan. 25, 2008

(86) PCT No.: PCT/JP2008/051609

§ 371 (c)(1), (2), (4) Date: Jun. 16, 2009

(87) PCT Pub. No.: WO2008/091027

PCT Pub. Date: Jul. 31, 2008

(65) Prior Publication Data

US 2010/0071637 A1 Mar. 25, 2010

(30) Foreign Application Priority Data

Jan. 25, 2007 (JP) ..... 2007-014692

(51) Int. Cl.
*F01P 7/00* (2006.01)

(52) U.S. Cl. ..... 123/41.02

(58) Field of Classification Search ..... 123/41.02, 123/41.01, 41.05, 41.44, 41.51, 41.55
See application file for complete search history.

(56) References Cited

U.S. PATENT DOCUMENTS 4,475,485 A * 10/1984 Sakakibara et al. ..... 123/41.05
4,475,785 A * 10/1984 Muller et al. ..... 439/298
4,557,223 A * 12/1985 N Gueyen ..... 123/41.12
4,577,594 A 3/1986 Hayashi et al.
4,605,163 A * 8/1986 Hayashi ..... 237/2 A
4,648,356 A * 3/1987 Hayashi ..... 123/41.21
4,648,357 A 3/1987 Hayashi
4,677,942 A 7/1987 Hayashi
4,955,431 A * 9/1990 Saur et al. ..... 165/271
(Continued)

FOREIGN PATENT DOCUMENTS

JP Y2-07-002977 1/1995
(Continued)

OTHER PUBLICATIONS

Russian Office Action dated Dec. 8, 2010 in Russian Patent Application No. 2009128707/06(039913) (with translation).

*Primary Examiner* — Noah Kamen
*Assistant Examiner* — Long T Tran
(74) *Attorney, Agent, or Firm* — Oliff & Berridge, PLC

(57) ABSTRACT

A cooling apparatus that cools with coolant a subject of cooling, which is a heat source. The cooling apparatus includes a cooling circuit, an electric pump, a switching section, and a control section. Through circulation of the coolant, air in the cooing circuit is caused to flow to an air bleeding portion and is discharged from the cooling circuit through the air bleeding portion. The switching section is capable of switching the operation mode of the electric pump between a normal mode and an air bleeding mode for collecting air in the cooling circuit to the air bleeding portion. During the air bleeding mode, the control section is capable of controlling the electric pump to change a coolant displacement from the electric pump according to a change pattern that allows stagnant air in sections of the cooling circuit to flow to the air bleeding portion.

2 Claims, 6 Drawing Sheets

U.S. PATENT DOCUMENTS

| | | | | |
|---|---|---|---|---|
| 5,241,926 | A | 9/1993 | Sato et al. | |
| 5,992,755 | A | 11/1999 | Kuze | |
| 6,138,617 | A | 10/2000 | Kuze | |
| 6,668,766 | B1 * | 12/2003 | Liederman et al. | 123/41.44 |
| 6,776,126 | B2 | 8/2004 | Le Lievre et al. | |
| 6,955,151 | B2 * | 10/2005 | Naljotov et al. | 123/197.1 |
| 2006/0096553 | A1 * | 5/2006 | Takahashi | 123/41.1 |
| 2007/0272174 | A1 * | 11/2007 | Szalony et al. | 123/41.14 |

FOREIGN PATENT DOCUMENTS

| | | | |
|---|---|---|---|
| JP | A-2003-529703 | | 10/2003 |
| JP | A-2004-060598 | | 2/2004 |
| JP | A-2005-016433 | | 1/2005 |
| JP | A-2005-90236 | | 4/2005 |
| RU | 2212549 | C2 | 8/2000 |
| RU | 2 280 178 | C1 | 7/2006 |

* cited by examiner

COOLING APPARATUS

FIELD OF THE INVENTION

The present invention relates to a cooling apparatus that cools a subject of cooling, which is a heat source, with coolant that circulates in a cooling circuit.

BACKGROUND OF THE INVENTION

Conventional cooling apparatuses of this type include the one disclosed in Japanese Laid-Open Patent Publication No. 2005-16433. The apparatus of the publication cools a vehicle engine by circulating coolant in a cooling circuit through the operation of a pump. The pump, which circulates coolant in the cooling circuit, may be a mechanical pump driven by the engine or an electric pump driven by a motor, which is a driving source separate from the engine.

When changing coolant in a cooling apparatus, old coolant is first drained from the circuit. Then, the circuit is filled with new coolant. After the filling of the new coolant, a certain amount of air remains in the cooling circuit. If the cooling circuit is started with the remaining air, the cooling efficiency of the engine and the discharge efficiency of the pump are lowered. Thus, an air bleeding portion needs to be provided to the cooling circuit, and air in the circuit needs to be caused to flow to the air bleeding portion, so that the air is discharged to the outside. In other words, air bleeding needs to be performed.

Specifically, such air bleeding is performed by causing air to the air bleeding portion by means of the flow of coolant in the cooling circuit using a pump when air exists in the cooling circuit, for example, after a change of the coolant. By causing the air in the cooling circuit to the air bleeding portion, the air is collected and stored in the air bleeding portion. This allows air in the cooling circuit to be discharged from the circuit.

By causing air in the cooling circuit to flow to the air bleeding portion through the operation of the pump, and storing the air in the air bleeding portion as described above, the air can be discharged from the cooling circuit. However, air in the cooling circuit cannot always be efficiently collected in the air bleeding portion, and it takes some time to collect the air in the air bleeding portion. This drawback is related to the fact that air exists in a number of sections in the cooling circuit, and the resistance to air flow differs from one section to another.

That is, if the coolant displacement of the pump for air bleeding is determined in accordance with the air located in sections of low resistance to air flow among several sections at which stagnant air exists in the cooling circuit, stagnant air in sections of high resistance to air flow cannot be caused to smoothly flow to the air bleeding portion by the flow of the coolant generated by the operation of the pump in the coolant circuit. Therefore, it requires some time to collect air in the cooling circuit to the air bleeding portion through the operation of the pump.

If the coolant displacement of the pump for air bleeding is determined in accordance with the air located in sections of high resistance to air flow in the cooling circuit, the flow of coolant generated by the operation of the pump is excessively strong for causing stagnant air in sections of low resistance to air flow to flow. As a result, such air is diffused in the coolant as bubbles. Thus, collecting air in the cooling circuit to the air bleeding portion through the operation of the pump takes relatively long time.

Such a problem is not uniquely found in a cooling apparatus that cools a vehicle engine, which is a subject of cooling and a heat source, but also substantially similarly found in any cooling apparatus that cools a subject of cooling other than vehicle engines.

DISCLOSURE OF THE INVENTION

Accordingly, it is an objective of the present invention to provide a cooling apparatus that efficiently collects air in a cooling circuit into an air bleeding portion when performing air bleeding of the cooling circuit.

To achieve the foregoing objective and in accordance with one aspect of the present invention, a cooling apparatus for cooling a subject of cooling, which is a heat source, with coolant is provide. The apparatus includes a cooling circuit, an electric pump, a switching section, and a control section. The cooling circuit contains the coolant and passes through the subject of cooling. The cooling circuit has an air bleeding portion. The electric pump is operated to circulate the coolant within the cooling circuit. Air in the cooling circuit is caused to flow to the air bleeding portion through circulation of the coolant and is discharged from the cooling circuit through the air bleeding portion. The switching section is capable of switching the operation mode of the electric pump between a normal mode and an air bleeding mode for collecting air in the cooling circuit to the air bleeding portion. During the air bleeding mode, the control section is capable of controlling the electric pump to change a coolant displacement from the electric pump according to a change pattern that allows stagnant air in sections of the cooling circuit to flow to the air bleeding portion.

DETAILED DESCRIPTION OF THE INVENTION PREFERRED EMBODIMENTS

Figure 1:
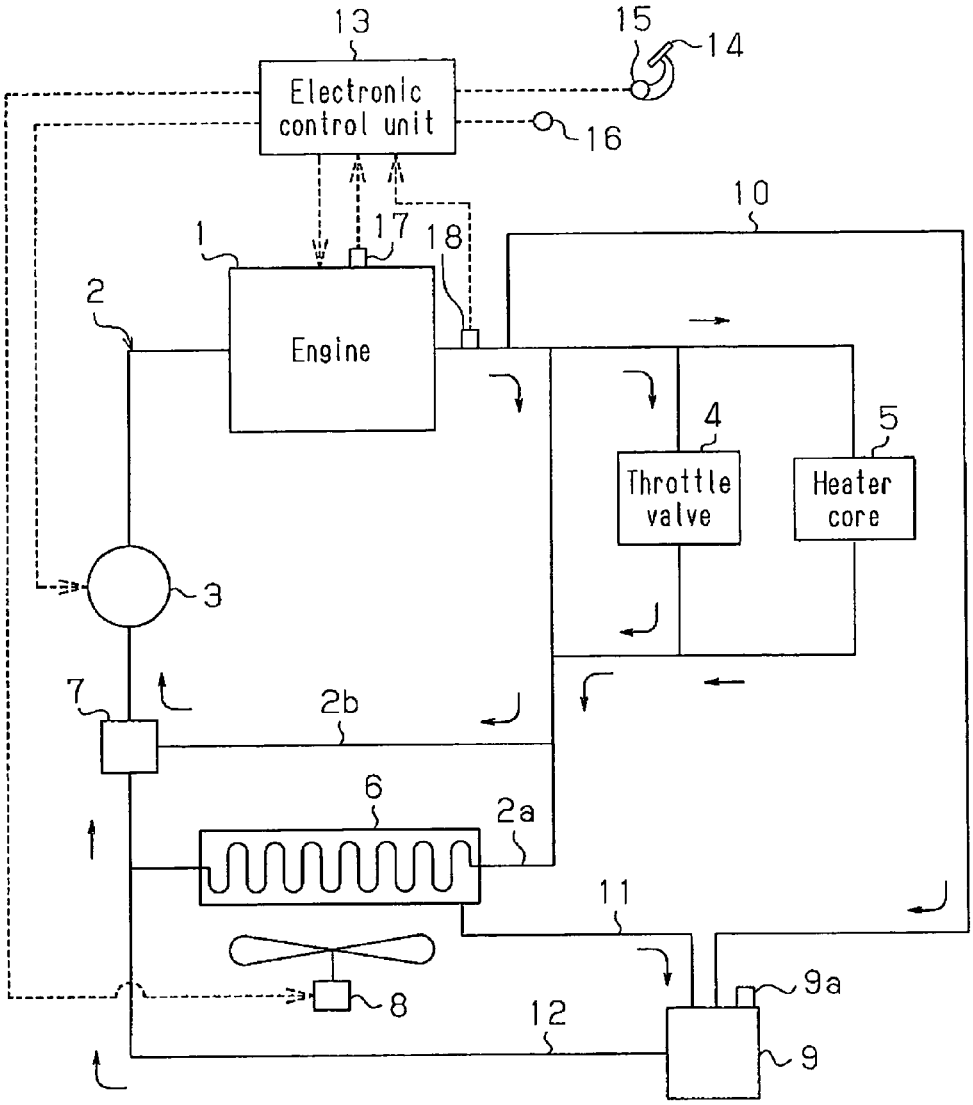
FIG. 1 is a diagram showing a cooling apparatus according to a first embodiment of the present invention.
Figure 2:
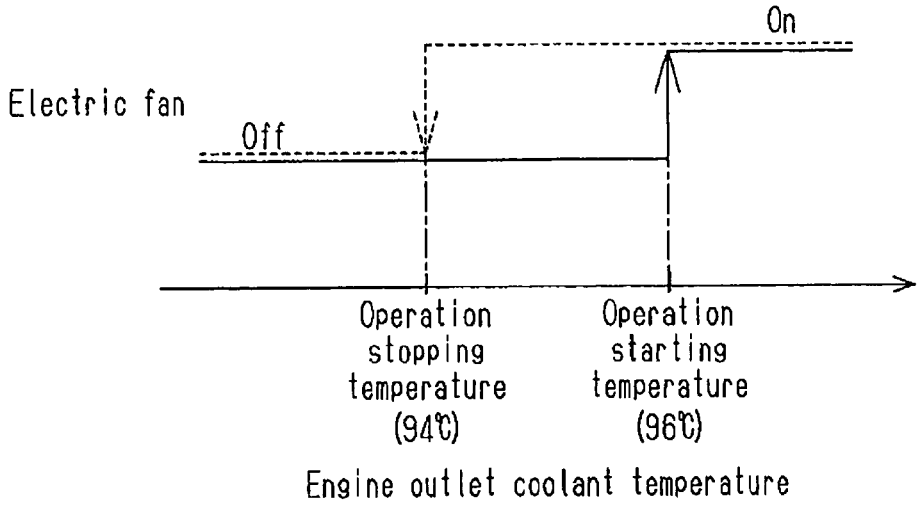
FIG. 2 is a diagram showing a manner in which an electric fan of the cooling apparatus shown in FIG. 1 operates in accordance with an engine outlet coolant temperature.

A cooling apparatus according to a first embodiment of the present invention will now be described with reference to FIGS. 1 to 5. The cooling apparatus is applied to a vehicle engine.

The cooling apparatus according to the first embodiment has a cooling circuit 2 that passes through an engine 1 mounted on a vehicle, and an electric pump 3 that is operated to circulate coolant within the cooling circuit 2. When the electric pump 3 is activated so that the coolant circulates in the cooling circuit 2 and passes through the engine 1, heat exchange takes place between the coolant and the engine 1. This cools the engine 1 and increases the temperature of the coolant that is discharged from the engine 1, or an engine outlet coolant temperature. The cooling circuit 2 passes through a throttle valve 4 and a heater core 5 of an air conditioner. Some of the coolant circulating in the cooling circuit 2 is conducted to the throttle valve 4 and the heater core 5.

The cooling circuit 2 is provided with a heat exchanger 6, which causes heat exchange between the coolant and the outside air, thereby cooling the coolant. The cooling circuit 2 bifurcates at a section upstream of the heat exchanger 6 into a passage 2*a*, which passes through the heat exchanger 6, and a passage 2*b*, which detours the heat exchanger 6. The passages 2*a*, 2*b* merge into one passage at a section of the cooling circuit 2 that is downstream of the heat exchanger 6. A thermostat 7 is located at the section where the passages 2*a*, 2*b* merge. The thermostat 7 selectively blocks or permits the flow of coolant into the heat exchanger 6 through the passage 2*a*. The thermostat 7 includes a thermostatic valve, which opens only when the temperature of coolant that passes through the merging section of the passages 2*a*, 2*b* is high (for example, 80° C. or higher), and permits the flow of coolant to the heat exchanger 6 though the passage 2*a*.

Therefore, when the temperature of the coolant passing through the merging section of the passages 2*a*, 2*b* is not high, the thermostat 7 operates, or more specifically, the thermostatic valve closes. This blocks the flow of coolant to the heat exchanger 6 through the passage 2*a*. Also, when the temperature of the coolant passing through the merging section of the passages 2*a*, 2*b* is high, the thermostat 7 operates, or more specifically, the thermostatic valve opens. This permits coolant to flow to the heat exchanger 6 through the passage 2*a*. As the coolant passes through the heat exchanger 6, heat exchange takes place between the coolant and the outside air at the heat exchanger 6, which cools the coolant.

An electric fan (a fan) 8 is located in the vicinity of the heat exchanger 6. The electric fan 8 blows air to the heat exchanger 6. The operation of the electric fan 8 is started or stopped based on the temperature of the coolant after cooling the engine 1 (the engine outlet coolant temperature). That is, when the engine outlet coolant temperature is high, the electric fan 8 is activated so that air is blown to the heat exchanger 6, and heat exchange between the coolant and the outside air is promoted in the heat exchanger 6. As a result, the coolant is effectively cooled in the heat exchanger 6. When the engine outlet coolant temperature is low, the electric fan 8 is stopped so that air is not blown to the heat exchanger 6.

The cooling apparatus according to the first embodiment is of a hermetic type with the hermetically-sealed cooling circuit 2 and has a reservoir 9. When coolant runs short in the hermetically-sealed cooling circuit 2, the reservoir 9 supplies the corresponding amount of coolant to the cooling circuit 2. Further, the reservoir 9 temporarily stores excess amount of the coolant in the cooling circuit 2. The reservoir 9 has a vapor-liquid separation function for removing air from in the coolant in the hermetically-sealed cooling circuit 2, and includes a filling port 9*a* for refilling the reservoir 9 with coolant. By means of the vapor-liquid separation function, the reservoir 9 receives coolant in the gas phase in the reservoir 9, and temporarily stores the coolant in the liquid phase, thereby separates air from the coolant.

The reservoir 9 is connected to a passage 10 connected to the outlet of the engine 1 in the cooling circuit 2, a passage 11 connected to the uppermost portion of the heat exchanger 6 at which air in the cooling circuit 2 tends to become stagnant, and passage 12 connected a section of the passage 2*a* in the coolant circuit 2 that is downstream of the heat exchanger 6. When the temperature of the coolant in the cooling circuit 2 rises and the thermostat 7 operates to permit the flow of coolant to the heat exchanger 6 through the passage 2*a*, the coolant in the reservoir 9 flows to the cooling circuit 2 (the passage 2*a*) through the passage 12. As a result, the coolant at the outlet of the engine 1 in the cooling circuit 2 and the coolant in the uppermost portion of the heat exchanger 6 are sent to the reservoir 9 through the passages 10, 11 based on the coolant pressure in the cooling circuit 2. After the vapor-liquid separation at the reservoir 9, the coolant is conducted to the cooling circuit 2 (the passage 2*a*) through the passage 12.

Also, the cooling apparatus has an electronic control unit (a control section) 13, which controls the operation of various devices such as the engine 1 on the vehicle. The electronic control unit 13 includes a CPU that executes various computation processes related to control of the various devices, a ROM storing programs and data necessary for the control, a RAM for temporarily storing the computation results of the CPU, and input and output ports for inputting and outputting signals between the outside and the electronic control unit 13.

The input and output ports of the electronic control unit 13 are connected to various sensors such as a pedal position sensor 15, which detects the degree of depression (pedal depression amount) of an accelerator pedal (an accelerator) 14, an air flowmeter 16, which detects the intake air amount of the engine 1, an engine speed sensor 17, which detects the speed of the engine 1, and a coolant temperature sensor 18, which detects the engine outlet coolant temperature in the cooling circuit 2. On the other hand, the output ports of the electronic control unit 13 are connected to drive circuits such as a fuel injection valve of the engine 1, the electric pump 3, and the electric fan 8.

Based on detected signals from the above described sensors, the electronic control unit 13 grasps the operating condition of the engine 1. According to the grasped operating condition, the electronic control unit 13 outputs command signals to the drive circuits of the devices connected to the above output ports. In this manner, the electronic control unit 13 executes various types of control including control of the operation of the engine 1. Specifically, the electronic control unit 13 controls fuel injection and the electric pump 3 and the electric fan 8 in the cooling apparatus.

The adjustment of the power of the engine 1, which is performed through control of the fuel injection of the engine 1 by the electronic control unit 13, is performed, for example, as described below. That is, when the accelerator pedal 14 is depressed, the fuel injection of the engine 1 is controlled such that an engine power corresponding to the pedal depression degree is generated. Therefore, if the accelerator pedal 14 is depressed by a predetermined degree when the transmission of the engine power to the wheels is blocked, for example, when the vehicle is not moving, the engine speed is changed through the adjustment of the engine power in accordance with the amount of the pedal depression. If an engine racing operation, in which the pedal depression degree is abruptly increased from zero, is performed, the engine power is abruptly increased, accordingly, and the engine speed is increased.

The electronic control unit 13 controls the operation of the electric pump 3 by setting a pump duty, which is a drive command value of the electric pump 3, based on the engine operation state such as the engine speed and the engine load, and drives the electric pump 3 such that the coolant displacement corresponds to the pump duty. The pump duty is variable between a minimum value (for example, 40%) and a maximum value (100%). The more the heat generated by the operation of the engine 1 (for example, the greater the engine speed or the engine load is) is, the greater the value of the pump duty is set. The electric pump 3 is controlled such that the greater the value of the pump duty, the greater the displacement of the coolant becomes. Therefore, when the heat generated by the engine 1 is not great, for example, during idling, the displacement of the electric pump 3 is controlled to be constant at a small value, so that a small amount of coolant passes through the engine 1. Thus, the engine 1 is not cooled more than necessary. When the heat generated by the engine 1 is great, for example, during a high speed and high load operation, the electric pump 3 is controlled to increase the displacement, that is, the amount of coolant that passes through the engine 1. The coolant of the increased amount efficiently cools the engine 1.

The electronic control unit 13 controls the operation of the electric fan 8 by starting or stopping the operation of the electric fan 8 based on the engine outlet coolant temperature. Specifically, the operation of the electric fan 8 is started as indicated by a solid line in FIG. 2 when the engine outlet coolant temperature is equal to or higher than an operation starting temperature. After being started, the operation of the electric fan 8 is stopped as indicated by a broken line in FIG. 2 when the engine outlet coolant temperature is equal to or less than an operation stopping temperature, which is lower than the operation starting temperature. The operation starting temperature and the operation stopping temperature are set to temperatures higher than the temperature at which the thermostatic valve of the thermostat 7 is open (in the first embodiment 80° C.), and set to, for example, 96° C. and 94° C., respectively. Thus, when the temperature of coolant in the cooling circuit 2 (the engine outlet coolant temperature) is high, the electric fan 8 is activated so that air is blown to the heat exchanger 6, and the coolant is effectively cooled by the outside air at the heat exchanger 6. When the coolant temperature is low, the electric fan 8 is stopped so that air is not blown to the heat exchanger 6.

Next, air bleeding of the cooling circuit 2, which is performed when coolant is changed in the cooling apparatus, will be described with reference to FIG. 1.

When changing coolant in the cooling apparatus, old coolant is first drained from the circuit 2. Then, the new coolant is added to the reservoir 9 through the filling port 9*a*. The coolant added to the reservoir 9 through the filling port 9*a* enters the cooling circuit 2 from the reservoir 9 through the passages 10, 11. When the coolant enters the cooling circuit 2, air in the cooling circuit 2 is in turn forced to the reservoir 9 through the passages 10, 11 and is then discharged to the outside through the filling port 9*a*. When the cooling circuit 2 and the passages 10, 11 are filled with the coolant accordingly, and the coolant in the reservoir 9 reaches a predetermined level, the filling port 9*a* of the reservoir 9 is closed.

In this state, some air remains in the cooling circuit 2. Thus, after a change of coolant, air bleeding is performed to remove the air remaining in the cooling circuit 2. That is, the electric pump 3 is operated by causing the engine 1 to perform an autonomous operation, so that the coolant circulates in the cooling circuit 2. The temperature of the circulating coolant is increased to open the thermostatic valve of the thermostat 7. When coolant is circulated in the cooling circuit 2 through the operation of the electric pump 3, the flow of the coolant washes away stagnant air in several sections in the cooling circuit 2. After the thermostatic valve of the thermostat 7 is open, the coolant in the coolant circuit 2, together with the washed away air, is sent to the reservoir 9 through the passages 10, 11. In the reservoir 9, the air and the coolant are subjected to vapor-liquid separation, and the separated air is stored in the reservoir 9. On the other hand, after the vapor-liquid separation at the reservoir 9, the coolant is conducted to the cooling circuit 2 (the passage 2*a*) through the passage 12.

As described above, in the case where the thermostatic valve of the thermostat 7 is open, if the stagnant air in the cooling circuit 2 is washed away through the operation of the electric pump 3, the air flows to the reservoir 9 and is collected into the reservoir 9. Stagnant air in the cooling circuit 2 is collected into the reservoir 9, so that the air is discharged from the cooling circuit 2. The air bleeding of the circuit 2 is thus completed. Therefore, the reservoir 9, which is connected to the cooling circuit 2 through the passages 10 to 12, functions as an air bleeding portion into which stagnant air in the cooling circuit flows and is collected.

Even if the air bleeding of the cooling circuit 2 is performed in the above described manner, air in the cooling circuit 2 is not always efficiently collected into the reservoir 9. Thus, it takes time to collect the air into the reservoir 9. This drawback is caused by the fact that air exists in a number of sections in the cooling circuit 2, and the resistance to air flow differs from one section to another. For example, in the cooling circuit 2, the heat exchanger 6 is a section of a greater resistance to air flow compared to other sections. In other words, the resistance to air flow is the greatest at the heat exchanger 6 in the cooling circuit 2.

When the engine 1 is caused to perform autonomous operation to perform air bleeding from the cooling circuit 2, if the engine 1 is left idling, the pump duty drops to the minimum value (40%), and the displacement of the electric pump 3 drops to the minimum value. In this case, stagnant air in sections of low resistance to air flow is washed away by the coolant toward the reservoir 9. However, since the flow of coolant circulating in the cooling circuit 2 is weak, stagnant air in sections of high resistance to air flow is difficult to flow to the reservoir 9 in an efficient manner. Therefore, it requires some time to collect air in the cooling circuit 2 into the reservoir 9 portion through the operation of the electric pump 3.

To shorten the time required for the above described air bleeding, an operator may race the engine by depressing the accelerator pedal 14, so that the engine speed is increased and the displacement of the electric pump 3 is increased. In this case, the degree of depression of the accelerator pedal 14 during the engine racing operation is increased and the engine speed is excessively increased. This is likely to excessively increase the displacement of the electric pump 3. This is because, despite the fact that controlling the displacement of the electric pump 3 to an appropriate value requires an accurate pedal manipulation to an appropriate value of the pedal depression degree, the operator may be unable to execute such accurate pedal manipulation and depresses the accelerator pedal 14 by a great degree. If the displacement of the electric pump 3 is excessive, the flow of coolant in the cooling circuit 2 becomes too strong and diffuses air in sections of low resistance to air flow into the coolant as bubbles. In this case, also, it takes time to collect air in the cooling circuit 2 into the reservoir 9.

In the first embodiment, to deal with the above drawbacks, the electric pump 3 is controlled in a different manner during the air bleeding from the manner of the normal control. More specifically, the operation mode of the electric pump 3 can be switched between a normal mode in which the electric pump 3 is operated normally and an air bleeding mode in which the electric motor 3 is operated for bleeding air. In the air bleeding mode, the displacement of the electric pump 3 is controlled to be varied according to a changing pattern that enables stagnant air in various sections of the cooling circuit 2 flows to the reservoir 9. The electronic control unit 13 functions as a switching section that switches the operation mode of the electric pump 3 between the normal mode and the air bleeding mode.

The execution of the air bleeding mode allows the displacement of the electric pump 3 to change according to the above mentioned changing pattern. When the displacement of the electric pump 3 is reduced in accordance with the changing pattern, stagnant air in sections of low resistance to air flow in the cooling circuit 2 is caused to flow to the reservoir 9 and is collected into the reservoir 9. When the displacement of the electric pump 3 is increased in accordance with the changing pattern, and the flow of the coolant in the cooling circuit 2 becomes strong, stagnant air in sections of high resistance to air flow in the cooling circuit 2 is effectively caused to flow to the reservoir 9 and is collected into the reservoir 9. In this manner, by changing the displacement of the electric pump 3 according to the changing pattern, air in the cooling circuit 2 is efficiently collected into the reservoir 9.

A concrete procedure for changing the displacement of the electric pump 3 during the air bleeding mode according to the changing pattern will now be described.

Figure 3:
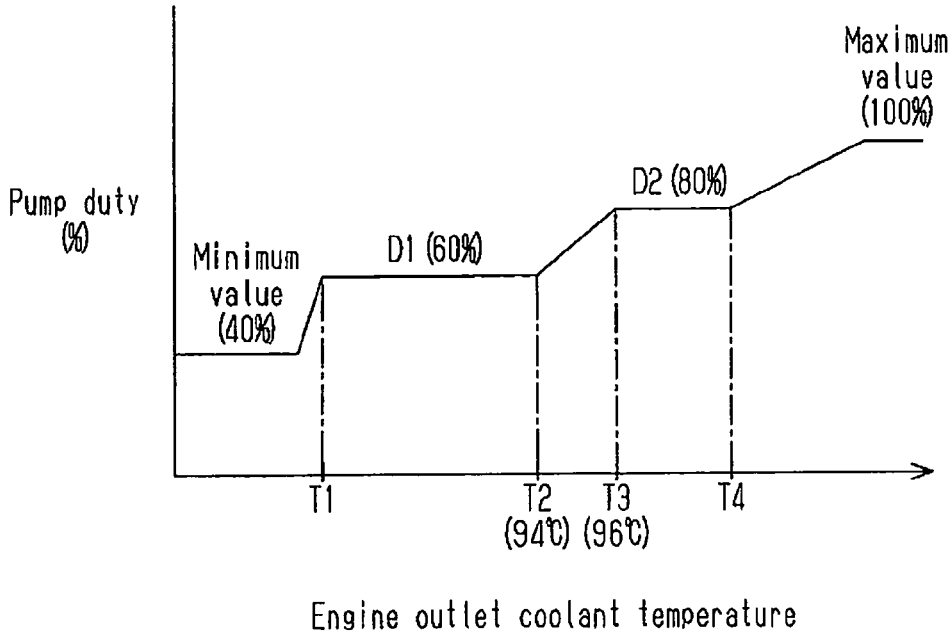
FIG. 3 is a diagram showing a manner in which a pump duty is varied in accordance with the engine outlet coolant temperature during an air bleeding mode.

Changes of the displacement of the electric pump 3 according to the changing pattern are achieved by setting the pump duty as shown in FIG. 3 based on the engine outlet coolant temperature. As shown in FIG. 3, during the air bleeding mode, the pump duty is increased as the engine outlet coolant temperature increases. When the engine outlet coolant temperature is in a low temperature range (T1-T2), the pump duty is maintained at a constant value D1. When the engine outlet coolant temperature is in a high temperature range (T3-T4), which is higher than the low temperature range (T1-T2), the pump duty is maintained at a constant value D2, which is greater than the value D1.

During the air bleeding mode, when the pump duty is set as shown in FIG. 3 based on the engine outlet coolant temperature, the displacement of the electric pump 3, which is operated based on the pump duty, changed in accordance with changes in the pump duty, which corresponds to changes in the engine outlet coolant temperature. That is, during the air bleeding mode, the displacement of the electric pump 3 is increased as the engine outlet coolant temperature increases. When the engine outlet coolant temperature is in the low temperature range (T1-T2), the displacement of the electric pump 3 is maintained at a first preset value, which corresponds to the pump duty D1. When the engine outlet coolant temperature is in the high temperature range (T3-T4), the displacement of the electric pump 3 is maintained at a second preset value, which corresponds to the pump duty D2. The second preset value is greater than the first preset value.

Therefore, the control of the electric pump 3 in the air bleeding mode includes a low temperature control and a high temperature control. In the low temperature control, the displacement of the electric pump 3 is maintained at the first preset value when the engine outlet coolant temperature is in the low temperature range. In the high temperature control, when the engine outlet coolant temperature is in the high temperature range, the displacement of the electric pump is maintained at the second preset value. The second preset value is a value that allows stagnant air in the heat exchanger 6, which is a section of the highest resistance to air flow in the cooling circuit 2 to, to flow. A value of the pump duty D2 for obtaining the second preset value is, for example, 80%. The first preset value is smaller than the second preset value and is optimum for allowing stagnant air in sections other than a section of the highest resistance to air flow in the cooling circuit 2 to flow. A value of the pump duty D1 for obtaining the first preset value is, for example, 60%.

When the air bleeding mode is executed while the engine 1 is caused to perform autonomous operation, coolant circulates through the cooling circuit 2 through the operation of the electric pump 3, and heat exchange between the coolant and the engine 1 increases the engine outlet coolant temperature. Therefore, after the start of the air bleeding mode, the longer the time elapsed, the higher the engine outlet coolant temperature becomes. As the outlet coolant temperature increases, the operation of the electric pump 3 is controlled based on the variable pump duty as shown in FIG. 3. Such control of the operation of the electric pump 3 allows the displacement of the electric pump 3 to be changed in accordance with the changing pattern shown above during the air bleeding mode.

During the execution of the air bleeding mode, when the engine outlet coolant temperature is being increased and within the low temperature range (T1-T2), the pump duty is maintained at a constant value D1 (60%). The displacement of the electric pump 3 is maintained at the first preset value. Accordingly, stagnant air in sections of low resistance to air flow in the cooling circuit 2 is caused to reliably flow to the reservoir 9 and is collected into the reservoir 9. Thereafter, during a period in which the engine outlet coolant temperature is in the high temperature range (T3-T4), the pump duty is maintained at the value D2 (80%). Accordingly, the displacement of the electric pump 3 is maintained at the second preset value, which is greater than the first preset value. Accordingly, stagnant air in sections of high resistance to air flow, for example, the heat exchanger 6, in the cooling circuit 2 is caused to reliably flow to the reservoir 9 and is collected into the reservoir 9. In this manner, stagnant air in sections of low resistance to air flow in the cooling circuit 2 and stagnant air in sections of high resistance to air flow in the cooling circuit 2 are reliably collected into the reservoir 9, respectively.

In the first embodiment, the operation stopping temperature (FIG. 2) of the electric fan 8 is associated with the low temperature range (T1-T2 in FIG. 3). The operation starting temperature (FIG. 2) of the electric fan 8 is associated with the high temperature range (T3-T4 in FIG. 3). Specifically, the operation stopping temperature and the low temperature range are determined such that the operation stopping temperature of the electric fan 8 is a value in the low temperature range, for example, the maximum value (T2) in the low temperature range. Thus, if the operation stopping temperature of the electric fan 8 is set to 94° C. as described above, the maximum value (T2) of the low temperature range is also set at 94° C. On the other hand, the operation starting temperature and the high temperature range are determined such that the operation starting temperature of the electric fan 8 is a value in the high temperature range, for example, the minimum value (T3) in the high temperature range. Thus, if the operation starting temperature of the electric fan 8 is set to 96° C. as described above, the minimum value (T3) of the high temperature range is also set at 96° C.

Figure 4:
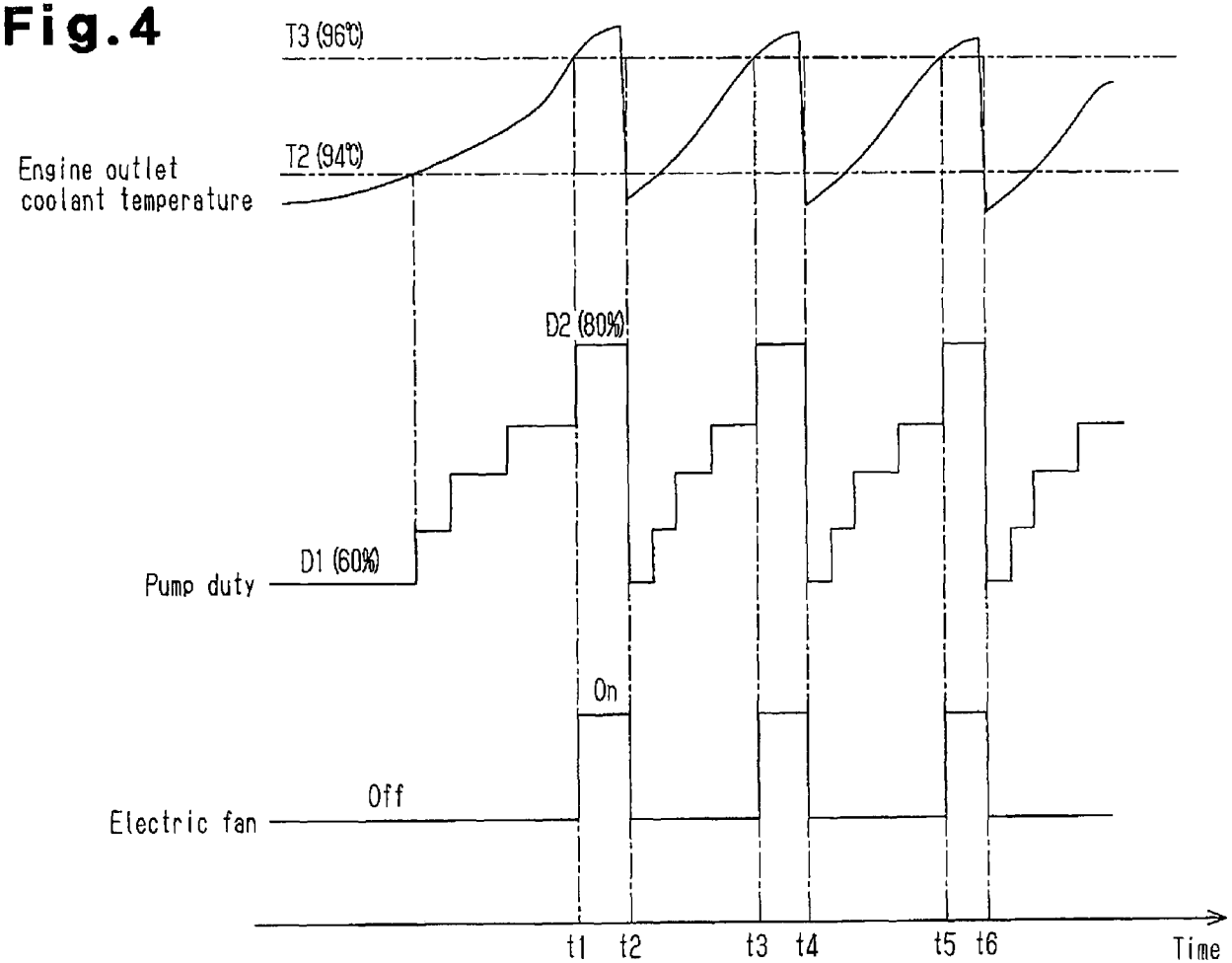
FIG. 4 is a timing chart showing changes in the engine outlet coolant temperature, the pump duty, and the operating state of the electric fan during the air bleeding mode.

FIG. 4 is a timing chart that shows changes in the engine outlet coolant temperature, the pump duty, and the operating state of the electric fan 8 during the air bleeding mode when the low temperature range and the high temperature range as well as the operation stopping temperature and the operation starting temperature are set.

During the air bleeding mode, if the engine outlet coolant temperature is increased from a value in the low temperature range (T1-T2) to a value in the high temperature range (T3-T4), the pump duty is changed from the value D1 (60%) to the value D2 (80%). Then, when the engine outlet coolant temperature becomes equal to or higher than the minimum value T3 (96° C.) in the high temperature range and the pump duty reaches the value D2 (time t1), the electric fan 8 is operated so that air is blown to the heat exchanger 6, and heat exchange is effectively executed between the coolant in the heat exchanger 6 and the outside air. As a result, the coolant that passes through the heat exchanger 6 is effectively cooled by the outside air, and the engine outlet coolant temperature is lowered, accordingly. When the engine outlet coolant temperature is lowered to the low temperature range and becomes equal to or lower than the maximum value T2 (94° C.) of the range (time t2), the pump duty becomes the value D1, and the operation of the electric fan 8 is stopped. Blow of air to the heat exchanger 6 is stopped. As a result, the coolant that passes through the heat exchanger 6 is not effectively cooled by the outside air, and the engine outlet coolant temperature is increased, accordingly.

The starting and stopping of the operation of the electric fan 8 and increase and decrease of the engine outlet coolant temperature are repeated thereafter. In the example shown in FIG. 4, such repetition occurs in a period from time t3 to time t6. As a result, the engine outlet coolant temperature goes back and forth between the low temperature range and the high temperature range, the displacement of the electric pump 3 is repeatedly maintained at the first preset value (corresponding to D1) and the second preset value (corresponding to D2). Accordingly, stagnant air in sections of low resistance to air flow in the cooling circuit 2 and stagnant air in sections of high resistance to air flow in the cooling circuit 2 are further reliably collected into the reservoir 9.

Finally, the addition of coolant to the cooling circuit 2, which accompanies change of coolant in the cooling apparatus, and the air bleeding from the cooling circuit 2 will now be described with reference to the flowchart of FIG. 5.

After draining old coolant from the cooling circuit 2, coolant addition for filling the cooling circuit 2 with new coolant is performed at step S101. Specifically, with the engine 1 stopped, the interior of the reservoir 9 is exposed to the atmosphere through the filling port 9*a*, and new coolant is added through the filling port 9*a*. Accordingly, the cooling circuit 2 and the passages 10, 11 are filled with the new coolant, and being replaced by the new coolant, air in the cooling circuit 2 and the passages 10, 11 is pushed away and discharged through the filling port 9*a*. When the new coolant fills up to a predetermined position in the reservoir 9, the filling port 9*a* of the reservoir 9 is closed.

Subsequently, in step S102, the air bleeding mode is executed. In this state, the autonomous operation, for example, idling of the engine 1 is performed in step S103. Further, in step S104, the control of the electric pump 3 in the air bleeding mode is executed based on the engine outlet coolant temperature. In step S105, the control of the electric fan 8 is executed based on the engine outlet coolant temperature. Through these control processes of the electric pump 3 and the electric fan 8, stagnant air in sections of low resistance to air flow and sections of high resistance to air flow in the cooling circuit 2 are reliably collected into the reservoir 9, and air is discharged from the cooling circuit 2 to the reservoir 9 (air bleeding).

When a certain time elapses after the air bleeding from the cooling circuit 2 is finished, the engine 1 is stopped in step S106. Accordingly, the control of the electric pump 3 and the control of the electric fan 8 are stopped. In step S107, whether the level of coolant in the reservoir 9 is lower than a reference range is determined. When the coolant level in the reservoir 9 is lower than the reference range, the coolant level has been lowered due to the air bleeding from the cooling circuit 2. Thus, the electronic control unit 13 determines that the air bleeding from the cooling circuit 2 has not be complete, and proceeds to step S108. In this case, additional filling of coolant through the filling port 9*a* of the reservoir 9 is performed in step S108. Thereafter, step S102 and the subsequent steps are repeated. When the coolant level in the reservoir 9 is within the reference range, the coolant level has not been lowered due to the air bleeding from the cooling circuit 2. Thus, the electronic control unit 13 determines that the air bleeding from the cooling circuit 2 has been completed. In this case, the air bleeding is ended, and the operation mode is switched from the air bleeding mode to the normal mode.

The above described first embodiment has the following advantages.

(1) The operation mode of the electric pump 3 can be switched between a normal mode in which the electric pump 3 is operated normally and an air bleeding mode in which the electric motor 3 is operated for bleeding air. In the air bleeding mode, the displacement of the electric pump 3 is controlled to be varied according to a changing pattern that enables stagnant air in various sections of the cooling circuit 2 flows to the reservoir 9. When executing air bleeding from the cooling circuit 2, the displacement of the electric pump 3 is changed in accordance with the above described changing pattern through the control of the electric pump 3 in the air bleeding mode. In this case, when the displacement of the electric pump 3 is reduced in accordance with the changing pattern, stagnant air in sections of low resistance to air flow in the cooling circuit 2 is caused to flow to the reservoir 9 and is collected into the reservoir 9. Also, when the displacement of the electric pump 3 is increased in accordance with the changing pattern, and the flow of the coolant in the cooling circuit 2 becomes strong, stagnant air in sections of high resistance to air flow in the cooling circuit 2 is effectively caused to flow to the reservoir 9 and is collected into the reservoir 9. Accordingly, when the air bleeding from the cooling circuit 2 is executed after change of coolant in the cooling apparatus, stagnant air in some sections in the cooling circuit 2 is efficiently collected into the reservoir 9.

(2) When the air bleeding mode is executed while the engine 1 is caused to perform autonomous operation, the electric pump 3 is operated and coolant circulating through the cooling circuit 2 receives heat from the engine 1, and the engine outlet coolant temperature is raised as time elapses. The pump duty is set such that, as the engine outlet coolant temperature is increased, the pump duty is increased as shown in FIG. 3. The electric pump 3 is controlled based on the pump duty. The variably controlled pump duty and the control of the electric pump allow the displacement of the electric pump 3 to be changed in accordance with the changing pattern shown above during the air bleeding mode.

(3) According to the changing pattern of the displacement of the electric pump 3, the displacement of the electric pump 3 is changed from a small value to a great value. Thus, when the displacement of the electric pump 3 is increased, stagnant air in sections of low resistance to air flow in the cooling circuit 2 has already been caused to flow to the reservoir 9. Therefore, when the displacement of the electric pump 3 is great, stagnant air in sections of low resistance to air flow in the cooling circuit 2 is not diffused as bubbles in the coolant by the strong flow of the coolant in the cooling circuit 2. That is, air is easily collected into the reservoir 9.

(4) While the engine outlet coolant temperature is rising within the low temperature range (T1-T2) shown in FIG. 3 during the air bleeding mode, the pump duty is maintained at the value D1 (60%), and the displacement of the electric pump 3 is maintained at the first preset value. The first preset value is an optimum value for allowing stagnant air in sections in the cooling circuit 2 other than the section of the highest resistance to air flow to flow to the reservoir 9. Therefore, by maintaining the displacement of the electric pump 3 at the first preset value, stagnant air in the sections of low resistance to air flow in the cooling circuit 2 reliably flows to and is collected into the reservoir 9. Thereafter, while the engine outlet coolant temperature is within the high temperature range (T3-T4), the pump duty is maintained to the value D2 (80%). Accordingly, the displacement of the electric pump 3 is maintained at the second preset value, which is greater than the first preset value. The second preset value is a value at which stagnant air in the heat exchanger 6, which is a section of the highest resistance to air flow, is permitted to flow. Therefore, by maintaining the displacement of the electric pump 3 at the second preset value, stagnant air in the sections of high resistance to air flow in the cooling circuit 2 such as the heat exchanger 6 reliably flows to and is collected into the reservoir 9. In this manner, stagnant air in sections of low resistance to air flow in the cooling circuit 2 and stagnant air in sections of high resistance to air flow in the cooling circuit 2 are reliably collected to the reservoir 9.

(5) The operation stopping temperature of the electric fan 8 is set within the low temperature range (T1-T2), and the operation starting temperature of the electric fan 8 is set within the high temperature range (T3-T4). Thus, when the engine outlet coolant temperature is increased to the operation starting temperature (T3) in the high temperature range during the air bleeding mode, the electric fan 8 is activated and blows air to the heat exchanger 6. As a result, the coolant passing through the heat exchanger 6 is effectively cooled by the outside air. Accordingly, the engine outlet coolant temperature drops. Then, when the engine outlet coolant temperature is lowered to the operation stopping temperature (T2) in the low temperature range, the electric fan 8 is deactivated and stops blowing air to the heat exchanger 6. As a result, the coolant passing through the heat exchanger 6 stops being effectively cooled by the outside air. Accordingly, the engine outlet coolant temperature increases. In this manner, the engine outlet coolant temperature is caused to go back and forth between the low temperature range and the high temperature range by the activation and deactivation of the electric fan 8, so that the displacement of the electric pump 3 is repeatedly maintained at the first preset value (corresponding to D1) and the second preset value (corresponding to D2). Accordingly, stagnant air in sections of low resistance to air flow in the cooling circuit 2 and stagnant air in sections of high resistance to air flow in the cooling circuit 2 are effectively collected into the reservoir 9.

(6) The reservoir 9, which functions as an air bleeding portion to which stagnant air in the cooling circuit 2 is collected, is connected to the uppermost portion of the heat exchanger 6, which is a section of high resistance to air flow in the cooling circuit 2, and coolant is drawn to the reservoir 9 through the passage 11. Thus, during the air bleeding of the cooling circuit 2, air is effectively collected to the reservoir 9 from the uppermost portion of the heat exchanger 6, at which air in the cooling circuit 2 is likely to be stagnant.

(7) During the air bleeding mode, when the coolant temperature in the cooling circuit 2 is lower than the temperature at which the thermostatic valve of the thermostat 7 is opened and no coolant is drawn to the reservoir 9, the electric pump 3 is activated based on the engine outlet coolant temperature, which is set for effectively washing away stagnant air in the cooling circuit 2. If the electric pump 3 is not activated when the coolant temperature is lower than the temperature at which the thermostatic valve of the thermostat 7 is opened, stagnant air at the thermostatic valve cannot be washed away. As a result, such stagnant air degrades the sensitivity of the thermostatic valve to the coolant temperature, which can delay the opening of the thermostatic valve. Also, stagnant air at the heater core 5 cannot be washed away so that stagnant air at the heater core 5 may not be eliminated in an early stage. However, by activating the electric pump 3 as shown above, these drawbacks are eliminated.

Figure 6:
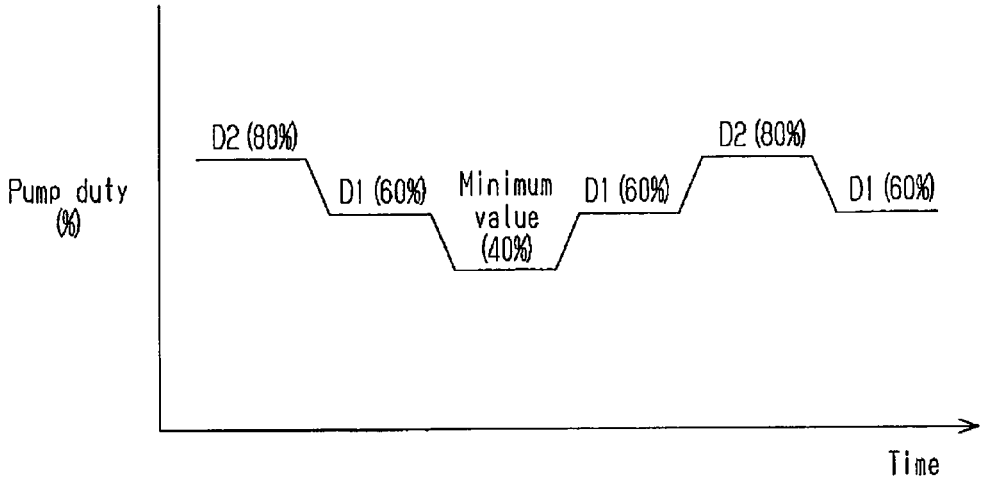
FIG. 6 is a diagram showing a manner in which a pump duty is varied as time elapses from when an air bleeding mode according to a second embodiment is started.

The second embodiment will now be described with reference to FIG. 6.

In the second embodiment, during the air bleeding mode, the operation of the electric pump 3 is controlled such that the displacement of the electric pump 3 changes in accordance with the elapsed time. Through the control, the displacement of the electric pump 3 is changed according to a change pattern that allows stagnant air in sections in the cooling circuit 2 to flow to the reservoir 9.

Changes of the displacement of the electric pump 3 according to the change pattern are achieved by setting the pump duty based on time elapsed from when the air bleeding mode is started. As shown in FIG. 6, during the air bleeding mode, the pump duty is repeatedly changed to D2 (80%), D1 (60%), the minimum value (40%), D1 (60%), and D2 (80%) each time a predetermined period has elapsed. The pump duty is constant other than at these changes.

Therefore, as the operation of the electric pump 3 is controlled during the air bleeding mode, the electric pump 3 discharges coolant the displacement of which corresponds to the pump duty, which is varied as time elapses. That is, each time the predetermined period of time elapses, the displacement of the electric pump 3 is increased or decreased according to changes of the pump duty, and the displacement is constant over time within each predetermined period. The maximum value of the displacement is a value that corresponds to the pump duty D2 (80%), that is, the first preset value in the first embodiment. Thus, stagnant air in the heat exchanger 6 is permitted to reliably flow to the reservoir 9.

According to the second embodiment, the following advantages are obtained in addition to the advantages of the items (1), (3), (6), and (7) of the first embodiment.

(8) When the air bleeding mode is performed, the operation of the electric pump 3 is controlled in such a manner that the displacement of the electric pump 3 changes in accordance with the elapsed time. In this manner, by controlling the operation of the electric pump 3, the displacement of the electric pump 3 is changed according to the change pattern of the pump displacement in the air bleeding mode.

(9) When the displacement of the electric pump 3 is maintained at a value that corresponds to the pump duty D1 (60%) during the air bleeding mode, stagnant air in sections of low resistance to air flow in the cooling circuit 2 flows to and is collected into the reservoir 9. When the displacement of the electric pump 3 is maintained at a value that corresponds to the pump duty D2 (80%) during the air bleeding mode, stagnant air in the heat exchanger 6, which is a section of the high resistance to air flow in the cooling circuit 2, is reliably permitted to flow to and is collected to the reservoir 9. Thus, stagnant air in sections of low resistance to air flow in the cooling circuit 2 and stagnant air in sections of high resistance to air flow in the cooling circuit 2 are reliably collected to the reservoir 9.

(10) The minimum value of the displacement of the electric pump 3, which is constant over time during the air bleeding mode, is a value that corresponds to the minimum value (40%) of the pump duty. Therefore, even if stagnant air in the cooing circuit 2 is diffused as bubbles due to the flow of coolant during the air bleeding, air (bubbles) diffused into the coolant is collected in a specific section in the cooling circuit 2 to stay there since the flow of coolant becomes weak when the displacement of the electric pump 3 is constant at a value that corresponds to the minimum value (40%) of the pump duty.

A third embodiment according to the present invention will now be described with reference to FIGS. 7 and 8.

In the third embodiment, the control of the operation of the electric pump 3 based on the engine speed is combined with engine racing operation of the accelerator pedal 14 such that, during the air bleeding mode, the displacement of the electric pump 3 is changed according to a change pattern that enables stagnant air in sections of the cooling circuit 2 to flow to the reservoir 9.

When engine racing operation is performed as a pedal operation, the engine speed is abruptly increased, accordingly. During the air bleeding mode, when the engine speed is abruptly increased by the engine racing operation, the pump duty based on the engine speed is set as shown in FIG. 7. This allows the displacement of the electric pump 3 to be changed according to the above described change pattern.

Figure 7:
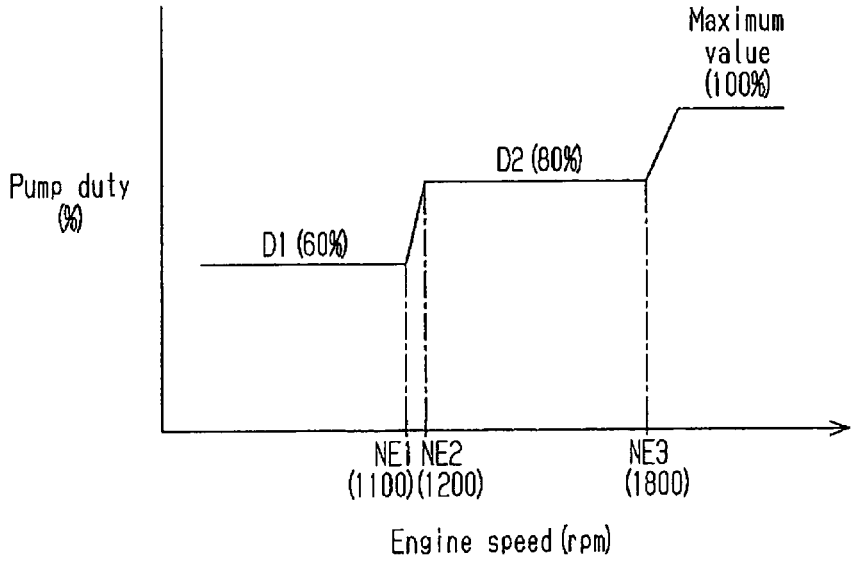
FIG. 7 is a diagram showing a manner in which a pump duty is varied based on changes in the engine speed during an air bleeding mode according to a third embodiment is started.

As shown in FIG. 7, the pump duty is increased as the engine speed is increased during the air bleeding mode. When the engine speed is in a low engine speed range (idle speed to NE1), the pump duty is constant at D1 (60%). When the engine speed is in a high engine speed range (NE2 to NE3), which is higher than the low engine speed range (idle speed to NE1) and corresponds to the engine speed when the engine racing operation is performed, the pump duty is constant at D2 (60%), which is greater than D1. In this embodiment, the low engine speed range is, for example, a range from the idle speed to 1100 rpm, and the high engine speed range is, for example, a range from 1200 rpm to 1800 rpm.

When the electric pump 3 is operated based on the pump duty that is changed according to the engine speed, the displacement of the electric pump 3 is changed in accordance with changes of the pump duty according to the engine speed. That is, the displacement of the electric pump 3 is increased as the engine speed increases. When the engine speed is in the low engine speed range (idle speed to NE1), the displacement of the electric pump 3 is maintained at a value that corresponds to the pump duty D1 (60%). When the engine speed is in the high engine speed range (NE2 to NE3), the displacement of the electric pump 3 is maintained at a value that corresponds to the pump duty D2 (80%). In the third embodiment, a value of the displacement of the electric pump 3 that corresponds to the pump duty D1 is a third preset value, and a value of the displacement of the electric pump 3 that corresponds to the pump duty D2 is a fourth preset value. The fourth preset value is greater than the third preset value.

Therefore, the control of the operation of the electric pump 3 during the air bleeding mode includes a low engine speed control, in which the displacement of the electric pump 3 is maintained at the third preset value when the engine speed is in a low engine speed range, and a high engine speed control, in which the displacement of the electric pump 3 is maintained at the fourth preset value when the engine speed is in the high engine speed range. Like the second preset value in the first embodiment, the fourth preset value is a value at which stagnant air in the heat exchanger 6, which is a section of the highest resistance to air flow in the cooling circuit 2, is permitted to flow. The third preset value is less than the fourth preset value. Like the first preset value in the first embodiment, the third preset value is an optimum value for allowing stagnant air in sections in the cooling circuit 2 other than the section of the highest resistance to air flow.

When the air bleeding mode is performed while the engine 1 is performing autonomous operation, the engine speed is within the low engine speed range (idle speed to NE1) in a state where the accelerator pedal 14 is not being depressed (pedal depression degree is zero). Thus, the pump duty is constant at D1 (60%), and the displacement of the electric pump 3 is maintained at the third preset value. In this state, stagnant air in sections of low resistance to air flow in the cooling circuit 2 flows to and is collected into the reservoir 9.

When the accelerator pedal 14 is depressed for racing the engine 1, the engine speed is increased from the low engine speed range to the high engine speed range (NE2 to NE3) and stays in the high engine speed range for a while. While the engine speed is in the high engine speed range, the pump duty is constant at D2 (80%), and the displacement of the electric pump 3 is constant at the fourth preset value. In this state, stagnant air in sections of the cooling circuit 2 of high resistance to air flow, such as the heat exchanger 6, is allowed to flow to and collected into the reservoir 9.

Therefore, by repeating the state in which the accelerator pedal 14 is not depressed and the state in which the engine 1 is raced, the coolant displacement of the electric pump 3 is changed according to the change pattern that allows stagnant air in sections of the cooling circuit 2 to flow to the reservoir 9. As a result, stagnant air in sections of low resistance to air flow in the cooling circuit 2 and stagnant air in sections of high resistance to air flow in the cooling circuit 2 are reliably collected to the reservoir 9.

Figure 8:
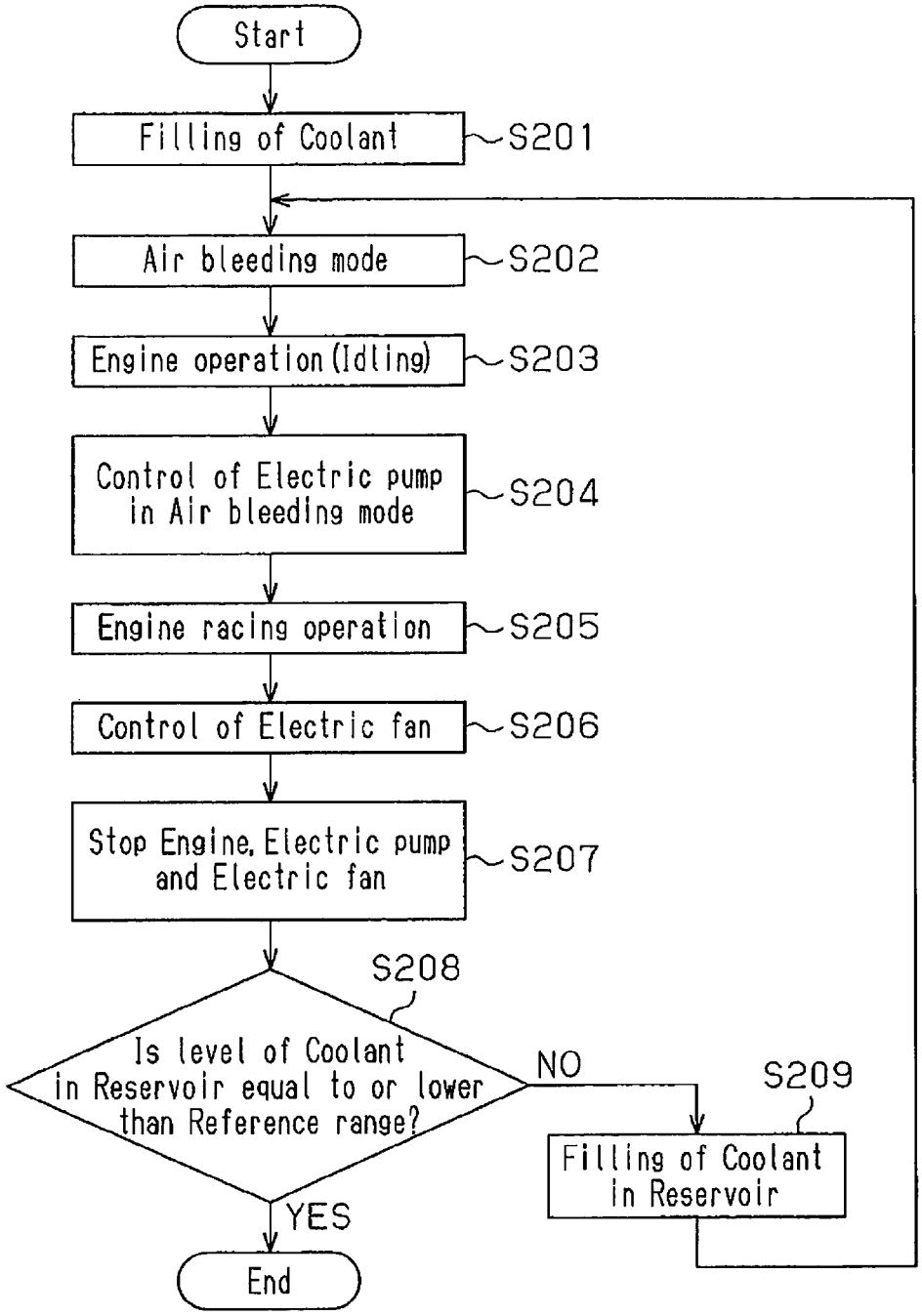
FIG. 8 is a flowchart showing a procedure for filling a cooling circuit 2 with coolant and a procedure of air bleeding from the cooling circuit 2.

FIG. 8 is a flowchart showing the procedure for filling the cooling circuit 2 with coolant, which accompanies change of coolant in a cooling apparatus according to the third embodiment. The flowchart also shows the procedure of air bleeding from the cooling circuit 2.

Figure 5:
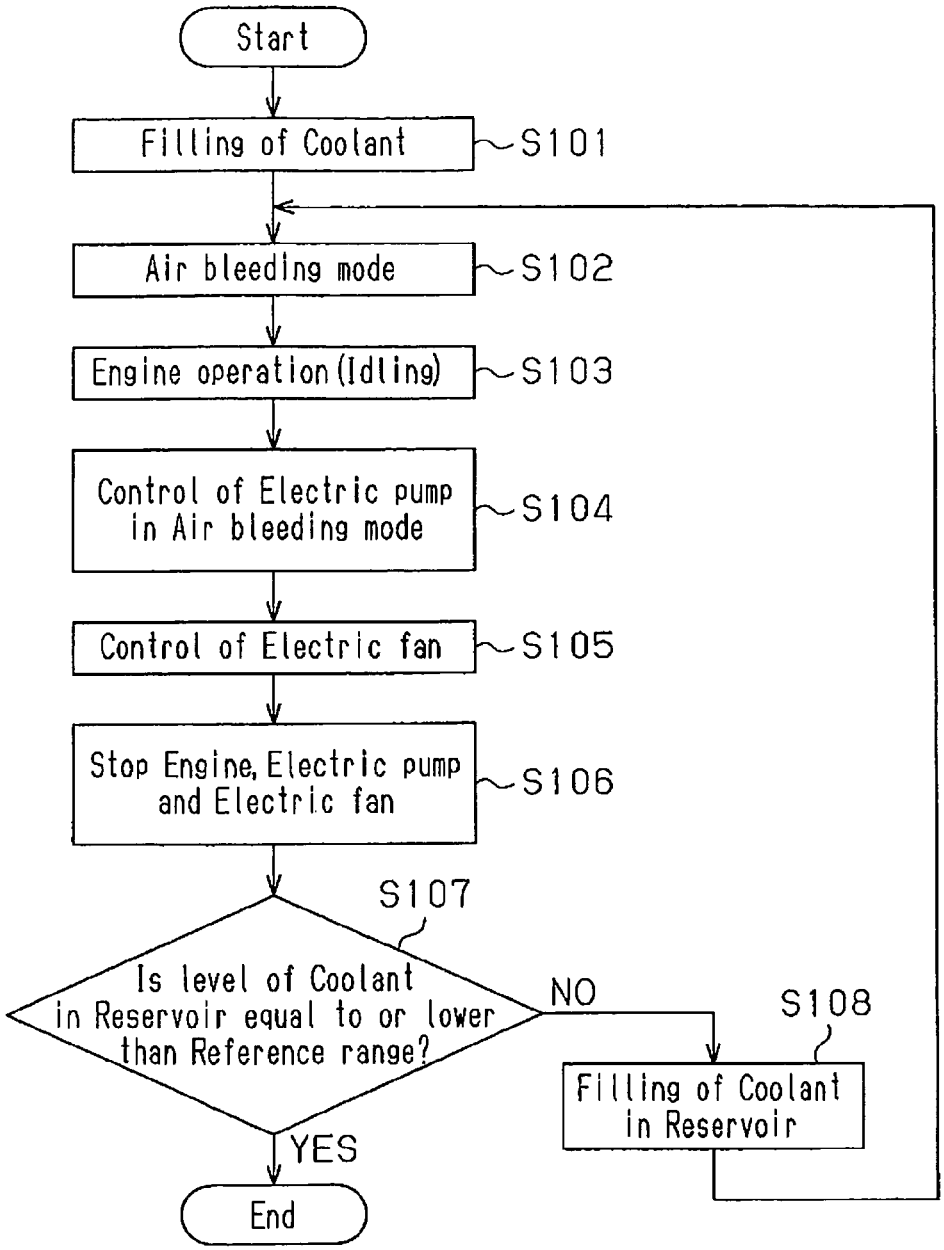
FIG. 5 is a flowchart showing a procedure for filling a cooling circuit 2 with coolant and a procedure of air bleeding from the cooling circuit 2.

In the flowchart of FIG. 8, the series of steps S201 to S203 and the series of steps S206 to S209 correspond to the series of steps S101 to S103 and the series of steps S105 to S108 shown in FIG. 5 according to the first embodiment, respectively. The flowchart of FIG. 8 is different from that of FIG. 5 in steps S204, S205.

In step S204, the operation of the electric pump 3 in the air bleeding mode is controlled. Specifically, the pump duty is varied as shown in FIG. 7 based on the engine speed, and the electric pump 3 is activated based on the varied pump duty. Thereafter, the electronic control unit 13 proceeds to step S205, and repeats several times a state in which engine racing operation, which is a pedal operation, is performed, and a state in which no pedal operation is performed.

The combination of the operation of the electric pump 3 based on the engine speed as described above and the engine racing operation through the operation of the accelerator pedal 14 allows the coolant displacement of the electric pump 3 to be changed according to a change pattern that allows stagnant air at sections in the cooling circuit 2 to flow to the reservoir 9. As a result, stagnant air in sections of low resistance to air flow in the cooling circuit 2 and stagnant air in sections of high resistance to air flow in the cooling circuit 2 are reliably collected to the reservoir 9.

According to the present embodiment as described above, the following advantages are obtained in addition to the advantages of the items (1), (3), (6), and (7) of the first embodiment.

(11) In a state where the operation of the electric pump 3 is controlled based on the engine speed in the air bleeding mode, by repeating several times the state in which the accelerator pedal 14 is not depressed and a state in which engine racing operation is performed, the coolant displacement of the electric pump 3 is changed according to the change pattern that allows stagnant air in sections of the cooling circuit 2 to flow to the reservoir 9. As a result, stagnant air in sections of low resistance to air flow in the cooling circuit 2 and stagnant air in sections of high resistance to air flow in the cooling circuit 2 are reliably collected to the reservoir 9.

(12) When engine racing operation is performed during the air bleeding mode and the engine speed is increased to the high engine speed range (NE2 to NE3), the pump duty is constant at D2 (80%). The displacement of the electric pump 3 is constant at a fourth preset value, accordingly. The fourth preset value is a value at which stagnant air in the heat exchanger 6, which is a section of the highest resistance to air flow, is permitted to flow. Thus, by maintaining the displacement of the electric pump 3 at the fourth preset value, stagnant air at the heat exchanger 6 reliably flows to and is collected into the reservoir 9.

(13) Since the temperature of the engine 1 is efficiently increased through engine racing operation, the temperature of the coolant circulating in the cooling circuit 2 is quickly increased to or above the valve opening temperature of the thermostatic valve in the thermostat 7. Thus, in an early stage after the air bleeding mode is started, coolant is allowed to flow through the heat exchanger 6, so that stagnant air in the heat exchanger 6 flows to the reservoir 9.

The above described embodiments may be modified as follows.

In the first embodiment, the operation stopping temperature and the operation starting temperature of the electric fan 8 may be changed as necessary. In this case, the operation stopping temperature is preferably set to a value in the low temperature range (T1-T2 in FIG. 3), and the operation starting temperature is preferably set to a value in the high temperature range (T3-T4 in FIG. 3).

In the second embodiment, the manner in which the pump duty is varied as time elapses during the air bleeding mode may be changed as necessary. For example, the pump duty may be repeatedly changed in the order of the minimum value (40%), D1 (60%), D2 (80%), D1 (60%), and the minimum value (40%) each time a predetermined period has elapsed. In this case, an advantage equivalent to the advantage of the item (3) of the first embodiment is achieved.

In the third embodiment, the low engine speed range and the high engine speed range may be changed as necessary.

In the first to third embodiments, the volume of the reservoir 9 may be increased. In this case, the process for adding coolant to the reservoir 9 (refill) during the air bleeding may be omitted.

In the first to third embodiments, the positions in the cooling circuit 2 to which the passages 10 to 12 are connected may be changed as necessary. For example, the passage 10 may be connected to a section of the cooling circuit 2 of high resistance to air flow, other than the heat exchanger 6. Also, the passage 12 may be connected to any section through which coolant flows regardless of opening and closing of the thermostatic valve of the thermostat 7.

In the first to third embodiments, the thermostat 7 may be omitted so that coolant always flows through the heat exchanger 6.

In the first to third embodiments, the electric fan 8 may be omitted.

In the first to third embodiments, the value of the pump duty D2, which is set for causing stagnant air in sections in the cooling circuit 2 of high resistance to air flow to flow, may be changed from 80% in accordance with the level of resistance to air flow, as necessary. Also, the value of the pump duty D1, which is set for causing stagnant air in sections in the cooling circuit 2 other than sections of high resistance to air flow to flow, may be changed from 60% in accordance with the level of resistance to air flow, as necessary. Further, the minimum value of the pump duty may be changed from 40% as necessary. In this case, the minimum value of the pump duty is preferably changed to a value suitable for storing and recollecting air that has been diffused as bubbles in coolant to a predetermined section in the cooling circuit 2.

In the first to third embodiments, a cooling apparatus of simplified sealing type may be used in which a filling port for adding coolant is provided at the uppermost portion of the heat exchanger 6 and the filling port is closed with a radiator cap. The radiator cap has a function for sealing the filling port and a function for releasing air in the uppermost portion of the heat exchanger 6 to the outside when the pressure of the air increases due to expansion of the coolant in the cooling circuit 2 caused by a temperature increase of the coolant. In this configuration, the reservoir is connected to the cooling circuit 2 (the heat exchanger 6) through a passage formed in the radiator cap, and the reservoir draws or sends out coolant in response to expansion and contraction caused by temperature changes of the coolant in the cooling circuit 2. Therefore, in such a cooling apparatus of a simplified sealing type, the uppermost portion of the heat exchanger 6 functions as an air bleeding portion to which stagnant air in the cooling circuit 2 is collected. In this configuration, the cooling circuit 2 can be refilled with coolant through the filling port during the air bleeding.

In the first to third embodiments, the engine 1 may be automatically stopped and restarted. In this configuration, the automatic stopping of the engine 1 is prohibited during the air bleeding mode. This is because if the engine 1 is automatically stopped during the air bleeding mode, the temperature of the coolant is not increased by the heat of the engine 1, and the thermostatic valve of the thermostat 7 may not be opened. Further, if the automatic stopping of the engine 1 is not prohibited during the air bleeding mode, the engine outlet coolant temperature, which is related to the control of the operation of the electric pump 3 during the air bleeding mode, cannot be increased. Also, in the third embodiment, the engine speed cannot be increased through the engine racing operation.

In the first to third embodiments, the present invention is applied to the cooling apparatus that cools the engine (internal combustion engine). However, the present invention may be applied to a cooling apparatus that cools any device other than the engine 1.

The invention claimed is:

1. A cooling apparatus for cooling a subject with coolant, the apparatus comprising:

a cooling circuit configured to contain the coolant and passes through the subject, the cooling circuit having an air bleeding portion;

an electric pump configured to circulate the coolant within the cooling circuit, wherein air in the cooling circuit is caused to flow to the air bleeding portion through circulation of the coolant and is discharged from the cooling circuit through the air bleeding portion;

a switching section that is configured to switch the operation mode of the electric pump between a normal mode in which the coolant is configured to be used for cooling the subject and an air bleeding mode in which the coolant is configured to be used for collecting air in the cooling circuit to the air bleeding portion, the air bleeding mode being configured to be executed after a new coolant is added into the cooling circuit, and the normal mode being configured to be executed at a timing that is different from when the air bleeding mode is executed; and a control section, during the air bleeding mode, configured to control the electric pump to change a coolant displacement from the electric pump such that the coolant displacement changes in accordance with an elapse of time after the new coolant is added into the cooling circuit so that the air in sections of the cooling circuit flows to the air bleeding portion, wherein the control section controls the electric pump such that the coolant displacement from the electric pump increases or decreases each time a predetermined period has elapsed, and within each of the predetermined period, the control section controls the electric pump such that the coolant displacement from the electric pump is constant relative to elapsed time.

2. The apparatus according to claim 1, further comprising a heat exchanger provided in the cooling circuit, wherein a maximum value of the displacement of the electric pump, which is constant relative to the elapsed time, is set to a value at which stagnant air in the heat exchanger is permitted to flow.

* * * * *